United States Patent [19]

Nakagaki et al.

[11] 4,307,496

[45] Dec. 29, 1981

[54] WARP-KNITTED LACE STRIP, MATERIAL FABRIC, AND MANUFACTURING METHOD THEREOF

[75] Inventors: Noboru Nakagaki; Yoyu Fujikawa, both of Fukui, Japan

[73] Assignee: Takeda Lace Co., Ltd., Japan

[21] Appl. No.: 81,067

[22] Filed: Oct. 2, 1979

[30] Foreign Application Priority Data

| | | | |
|---|---|---|---|
| Feb. 19, 1979 | [JP] | Japan | 54-18600 |
| Feb. 19, 1979 | [JP] | Japan | 54-18601 |
| Mar. 15, 1979 | [JP] | Japan | 54-30769 |
| Mar. 15, 1979 | [JP] | Japan | 54-30770 |
| Mar. 22, 1979 | [JP] | Japan | 54-34018 |

[51] Int. Cl.[3] ..... C08G 79/02; D04B 7/16

[52] U.S. Cl. ..... 28/168; 66/202

[58] Field of Search ..... 66/192, 193, 195, 202; 28/168

[56] References Cited

U.S. PATENT DOCUMENTS

| | | | |
|---|---|---|---|
| 2,365,315 | 12/1944 | Williams | 28/168 X |
| 4,096,610 | 6/1978 | Bassist | 66/202 X |

FOREIGN PATENT DOCUMENTS

| | | | |
|---|---|---|---|
| 2079718 | of 1971 | France | 66/192 |
| 22977277 | 8/1976 | France | 28/168 |
| 48-4231 | 2/1973 | Japan | 66/198 |

OTHER PUBLICATIONS

Wheatley, B. "Raschel Lace Manufacture", Nat. Ktd. At'wy Assoc., 1972, N.Y., N.Y., pp. 141 to 154.

*Primary Examiner*—Ronald Feldbaum
*Attorney, Agent, or Firm*—Eric P. Schellin

[57] ABSTRACT

This invention is concerned with a new textile product in the form of a lace strip which is entirely warp-knitted with sinuate scallops. The scallops are manufactured from bent scallop-forming yarns and picots of which one end protrudes outwardly in a U-shape configuration.

The novel lace strips are manufactured by forming chain stitch lines in step-like indentation by overlapping the scallop-forming yarns and passing the yarns in turn through a plurality of needles. Simultaneously picot-forming yarns are transversely positioned to produce protrusions from the scallops. In order to separate the scallops and their picots, the parts of the knitted fabric to be readily separated, said scallops and attached picots are knitted to soluble yarns which are subsequently dissolved to facilitate separation.

1 Claim, 10 Drawing Figures

WARP-KNITTED LACE STRIP, MATERIAL FABRIC, AND MANUFACTURING METHOD THEREOF

BACKGROUND OF THE INVENTION

Warp-knitted lace strips are used as border ornament of the underwear and outerwear for women. As shown in FIGS. 8 and 9, such lace strip 10 is generally provided with sinuate parts called scallops B consisting of repeated recesses and protrusions on the edge thereof and a large number of parts, each being called picot P, formed of U-bent yarns protruding from the scallops B. Conventional lace fabric of such kind has been knitted, in the direction shown by the arrow in the annexed drawing, chiefly by the raschel knitting machine, and in this case a plurality of units of lace strip have been knitted in the form of one piece of fabric that extending over the full width l of needle-row on the knitting machine and separated into units 10 in the later process.

Separation of the fabric piece into unit strips depends on cutting of the part 11 constituting only ground fabric construction interposed between adjacent two lace fabrics 10, 10 as shown in FIG. 8A along the sinuate line of scallops B by means of cutter 12 operated manually or mechanically. It also depends on such a method that a blasting yarn 14 for connecting picots P, P of adjacent lace fabrics 10, 10 as shown in FIG. 9 is beforehand knitted into the fabric and removed therefrom after completion of all-out knitting, when separate units of lace strip 10 are obtained.

However, these methods have been followed by drawbacks that separation by the use of cutter is low in operation efficiency when performed manually, correct cutting along sinuate line of the scallops is difficult in practical work, and moreover yarn ends 14 remain at the cut-end of the ground fabric, preventing fine finish of the outer edge of scallops B and clear protrusion of picot P, as shown in FIG. 8. In the case of mechanical cutting for separation, remaining of yarn ends at the outer edge of scallops B is similar to that in the previous case and prevents fine finish despite increased operation efficiency. Therefore, lace strips obtained by these methods have been extremely low in commercial value as border ornament.

Separation of the piece into units 10 according to release of basting yarn from the fabric is not followed by such drawbacks as those using the cutter but, on the other hand, followed by disadvantages as inferior ornamental properties resulting from the fact that: since the basting yarn 14 is knitted-in from sinuate scallops 10 to protruding picot P, agreement of protruding ends of picots P, P of adjacent lace fabrics 10, 10 with each other is required, which causes sinuation of the scallops to be weaker than that in the case of FIG. 8, particularly so and nearly straight at the protrusions B′ of scallops; and picots can not be provided in the resesses B″ of scallops.

SUMMARY OF THE INVENTION:

This invention has been intended for elimination of the above-described drawbacks.

The 1st object of this invention is to provide an entirely warp-knitted lace strip comprising knitting sinuate scallops to be formed of scallops-forming yarns on the edge of ground fabric and a large number of U-shaped picots protruding from the edge of scallops.

The 2nd object of this invention is to provide a material fabric for manufacturing warp-knitted lace strips in which the ground fabric, scallops to be knitted in the sinuate form on the edge of said ground fabric, and picots to protrude from the scallops are all knitted of insoluble yarns; and the protruding portion of picot is knitted-in into the soluble fabric portion formed in a series with and adjacently to the scallop.

The 3rd object of this invention is to provide a method of manufacturing warp-knitted lace strip from which the drawbacks as described above are eliminated by forming sinuate scallops and picots on the edge of insoluble fabric portion upon dissolving and removing the soluble fabric portion by the application of water or the like to the material fabric obtained in such a way as abovesaid.

The 4th object of this invention is to provide a material fabric for manufacturing warp-knitted lace strip in which the above-described insoluble fabric portion and soluble one are arranged alternately with each other along the direction of needle-row on the warp-knitting machine.

The 5th object of this invention is to provide a method of obtaining knitted lace strip in which insoluble fabric portions and soluble ones are knitted in an arrangement of alternation with each and soluble fabric portions are removed by dissolution after completion of all-out knitting, when insoluble fabric portions are separated into individual units, each unit being provided with sinuate scallops on the edge thereof as well as picots appearing on the scallops.

The 6th object of this invention is to provide a material fabric for manufacturing warp-knitted lace strips in which insoluble basting yarns are knitted-in between adjacent insoluble fabric portions so as to connect the two at the time of knitting of insoluble fabric portions and soluble ones in an arrangement of alternation with each other in the direction of needle-row on the warp-knitting machine.

The 7th object of this invention is to provide a method of manufacturing knitted lace strip wherein: when insoluble fabric portions and soluble ones are knitted into one piece in an arrangement of alternation with each other in the direction of needle row on the warp-knitting machine, adjacent insoluble fabric portions are adapted to be inseparable from each other, by knitting-in of insoluble basting yarns between these insoluble fabric portions, even after dissolution of soluble fabric portions so as to make easy the processing as drying after dissolving process; and individual lace strips are obtained when the fabric is separated by removal of said basting yarns after finishing process.

The above-described and other objects of this invention will be more apparent from the following descriptions quoted on the basis of annexed drawing as hereunder.

DETAILED DESCRIPTION OF THE INVENTION

Figure 1:
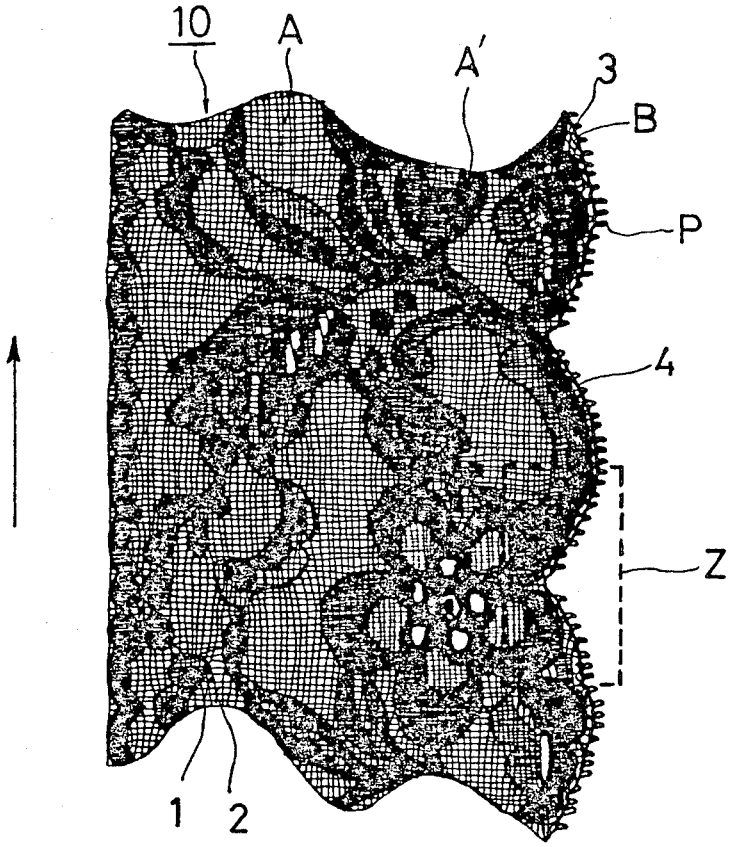
FIG. 1 is a sketch of a part of warp-knitted lace strip according to this invention.

In FIG. 1, the reference numeral 10 represents a unit of warp-knitted lace strip according to this invention. A warp-knitted lace strip of this kind is knitted along the direction of the arrow shown in the drawing and, in practice, continuous in both upward and downward directions in the drawing though not illustrated for simplification. This lace fabric 10 is composed of a multitude of lines of stitches, formed of a number of warps 1 and other warps 2 for connecting the lines of stiches with each other, thereby turning into marquisette ground fabric A on which the yarn for patterning are knitted-in by means of the Jacquard apparatus for producing the pattern A'. In the drawing of the lace fabric 10, scallops B in the shape of repeated sinuation are formed of the scallops-forming yarns 3 on the right-hand edge portion (will be called merely "edge" hereinafter). The numeral 4 denotes thick hemming yarns knitted-in into the scallops B. The reference character P indicates picots provided in large number on the edge of scallops B and formed by adapting the picot-forming yarns knitted-in into the scallops B in the shape of U to protrude from the scallops.

Then, a description will be made on a number of embodiments of structures and methods of knitting described above. In the description of FIGS. 2 through 7, any item corresponding to that in FIG. 1 is denoted by the same reference character and numeral as those refered to in FIG. 1 as far as possible.

Figure 2:
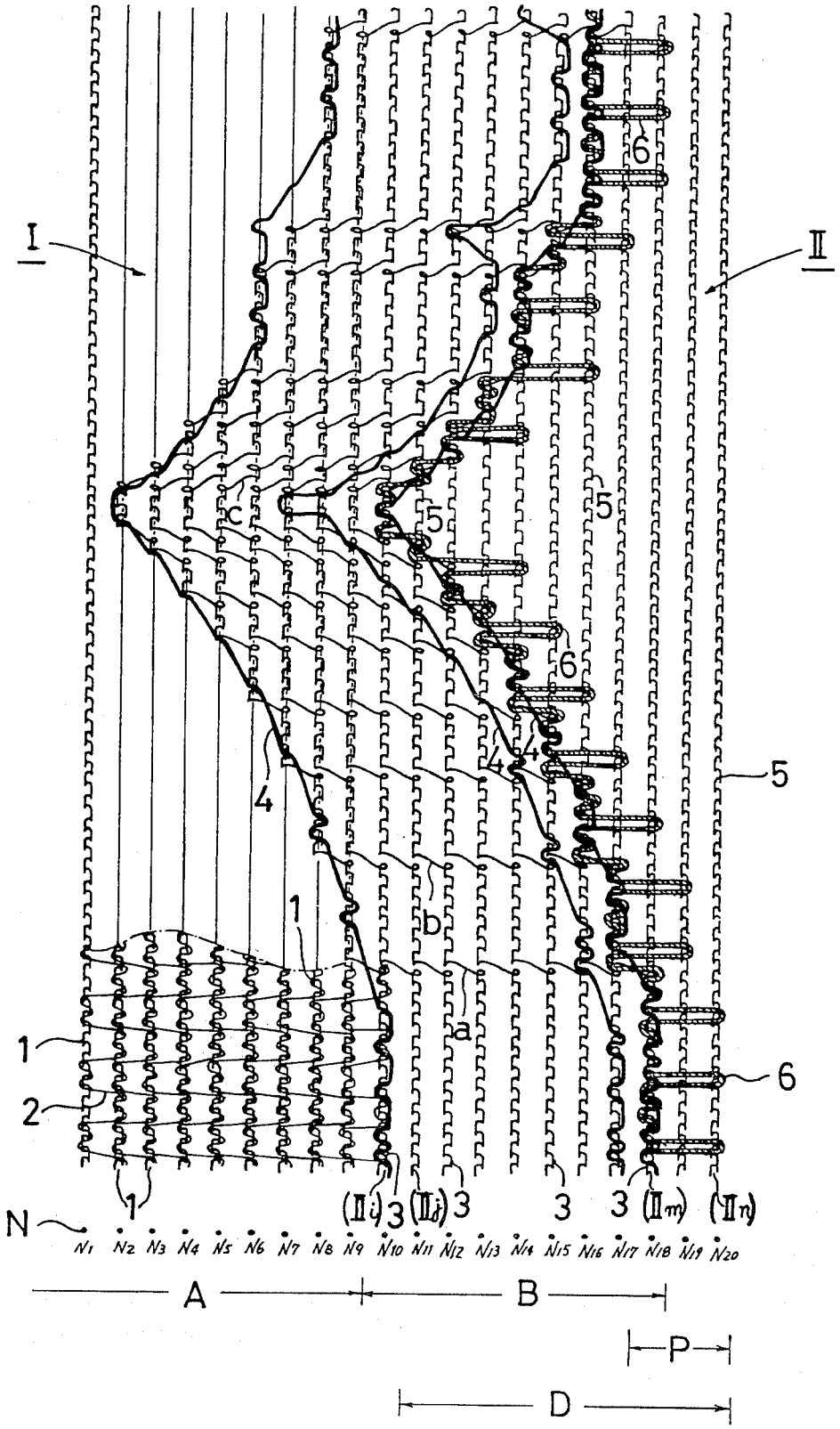
FIG. 2 is a view of knit structure of the part shown in FIG. 1 and enclosed by dotted line Z.

FIG. 2 is a view of knit structure almost corresponding to the part Z enclosed by dotted line in FIG. 1, A denoting the foundation texture, B the scallops, and P positions at which picots are formed. The character N shows the position of needle. The ground fabric is knitted of warps 1 and 2. For this knitting, needle $N_1$–$N_9$ are used. Each needle N forms chain stitches in every course of warp 1, and another warp 2 is interlaced between chain stitches adjacent to each other in the transverse direction, where a ground fabric A is formed. Describing this structure more detailedly with respect to needles $N_1$ and $N_2$, the warp 2 is inserted through consecutive three courses on the stitch-line formed by the needle $N_1$, transferred to the adjacent needle $N_2$, inserted into consecutive three courses on the stitch-line formed by the needle $N_2$ just like the previous procedure, and then returned to the initial needle $N_1$. Repetition of such processes with respect the needles $N_1$–$N_9$ form a marquisette structure, i.e. ground fabric A. Application of other structures than marquisette to knitting is not limited. As apparent from the description of FIG. 1, some appropriate pattern (not illustrated) is knitted-in onto the ground fabric A.

Nine ends in total of scallops-forming yarns denoted as 3 are shifted corresponding to sinuation of scallops B while forming stitches by means of respective nine pieces of needles. That is to say, nine ends of scallops-forming yarns are threaded on nine pieces of needles, $N_{10}$–$N_{18}$, at the 1st course (the lowest position in the drawing), overlapped at this needle-position so as to form chain stitches in line corresponding to the number of courses, shifted to left side at the course a at the rate of one needlepitch, i.e. to other nine needles, $N_9$–$N_{17}$, for next overlapping, form chain stitches in line corresponding to the required number of courses, at the position to which they are shifted, and, further, shifted to left side at the course b at the same rate as the previous one, i.e. one needle-pitch, or to needle $N_8$–$N_{16}$. When these yarns 3 reach the course C after repetition of above-described performance, they are shifted to right side at the rate of one needle-pitch and the overlapping positions thereof are shifted to right side step by step. As a result of repetition of such action as described above, sinuate scallops are formed. The yarns represented as 4 are hemming yarns for scallops, two end thereof being arranged on the outer edge, i.e. right side of FIG. 1, of the scallops B whereas one strand being on the inner edge, i.e. left side in FIG. 1, of the scallops, and are inserted into chain stitches in line of the scallops-forming yarns 3 for formation of knit structure while curving correspondingly to sinuation of the scallops B.

The above-described warp yarns 1 and 2 for composing the ground fabric A as well as 3 for scallops B, hemming yarns 4, and picot forming yarn 6 which will be described later are all water-insoluble and compose the whole of insoluble fabric portion I.

In contrast with this, a position in which soluble yarns 5 are knitted-in is indicated by the character D. These warp yarns 5 are drawn through a guide bar commonly used for the warp 1 and, in the embodiment shown in the drawing, ten ends in total thereof 5 are threaded on respective ten pieces of needles, $N_{11}$–$N_{20}$, which are arranged over the width D ranging from the wale ($II_j$) lying at a pitch of one gauge outside the wale ($II_i$) that corresponds to the bottom of scallops B to the wale ($II_n$) lying at a pitch of two gauges outside the wale ($II_m$) that corresponds to the end of scallops B protrusion. These warps 5 compose the soluble fabric portion II by forming chain stitches in all the wales in the same number as that of courses. Incidentally, the scallops-forming yarns 3 are overlapped on soluble warps 5 in some knitting area. The line of chain stitches formed of the warp 5 in this overlap area is not illustrated for simplification. As embodiments of soluble yarn 5 and insoluble one 1, used are vinylon yarn and nylon filament yarn, respectively.

The yarns represented as 6 are picot-forming yarns to be knitted-in into the scallops B, inserted into chain stitches formed in line of soluble yarns, being protruded in the same length as that of two gauges from the scallops edge at the required course, and returned to repeated insertion to the scallops B to produce a multitude of the U-shaped protrusions.

In this way, protruding parts of picots are fixed in the soluble fabric portion II.

Figure 3:
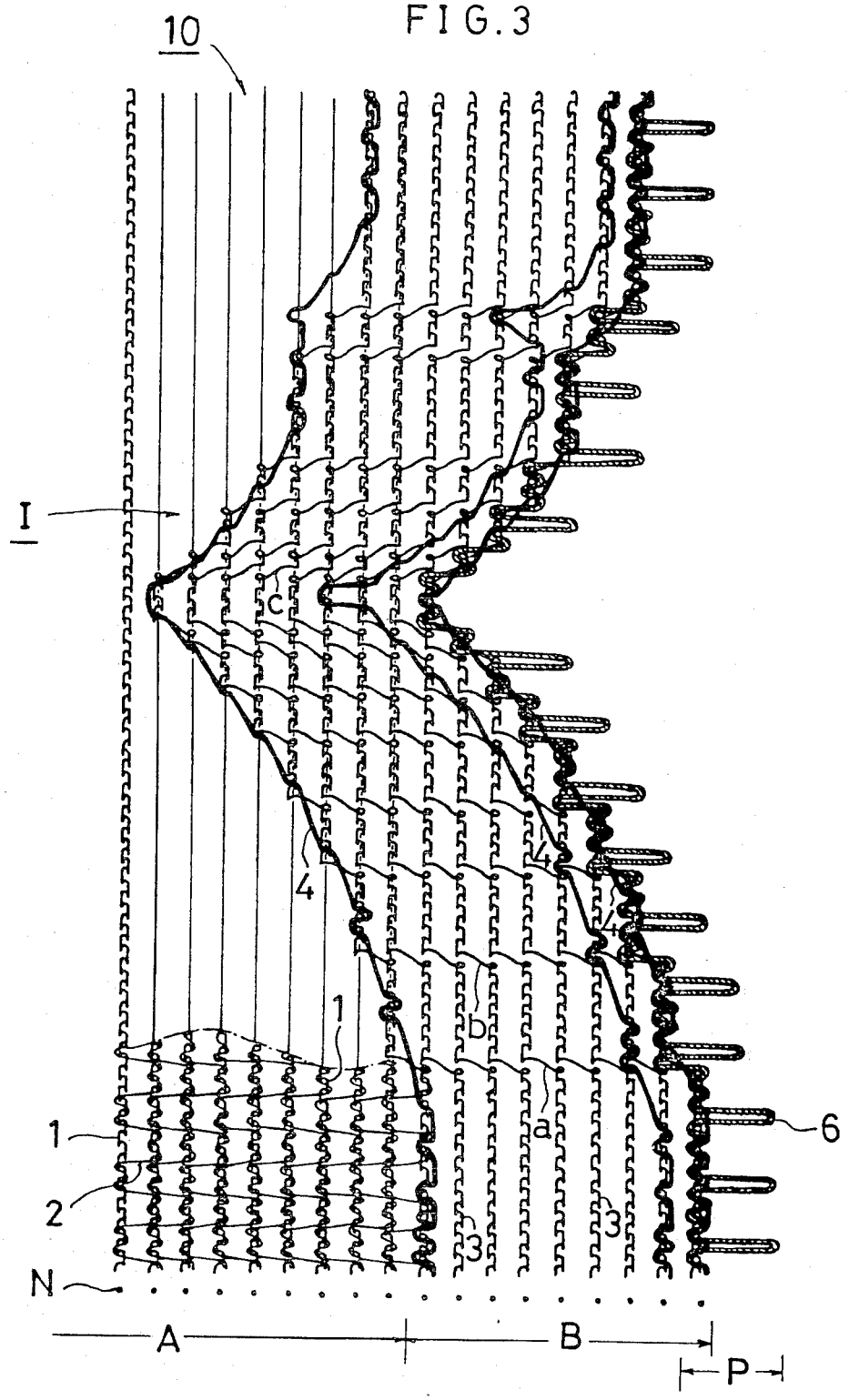
FIG. 3 is a view of knit structure of the part in FIG. 2 after removal of soluble texture by dissolution.

When the fabric thus obtained is immersed into the water in which the soluble fabric portion II is dissolved for removal, the edge of insoluble fabric portion I appears as sinuate scallops B provided with picots P as shown in FIG. 3.

Formation of sinuate scallops B of insoluble yarns on the edge of insoluble fabric portion I, formation of picots of similar insoluble yarn in the shape of protrusions from the scallops, and removal of soluble fabric portion by dissolution after knitting-in of picots into soluble fabric portion ensure not only clear appearance of picots but stronger sinuation of scallops, and, further, enable easy setting of the lengthes of picot protrusions as much as desired or varying said lengthes stepwise. Therefore, tasteful lace strips furnished with scallops and picots diversified in the shape can easily be manufactured.

Figure 4:
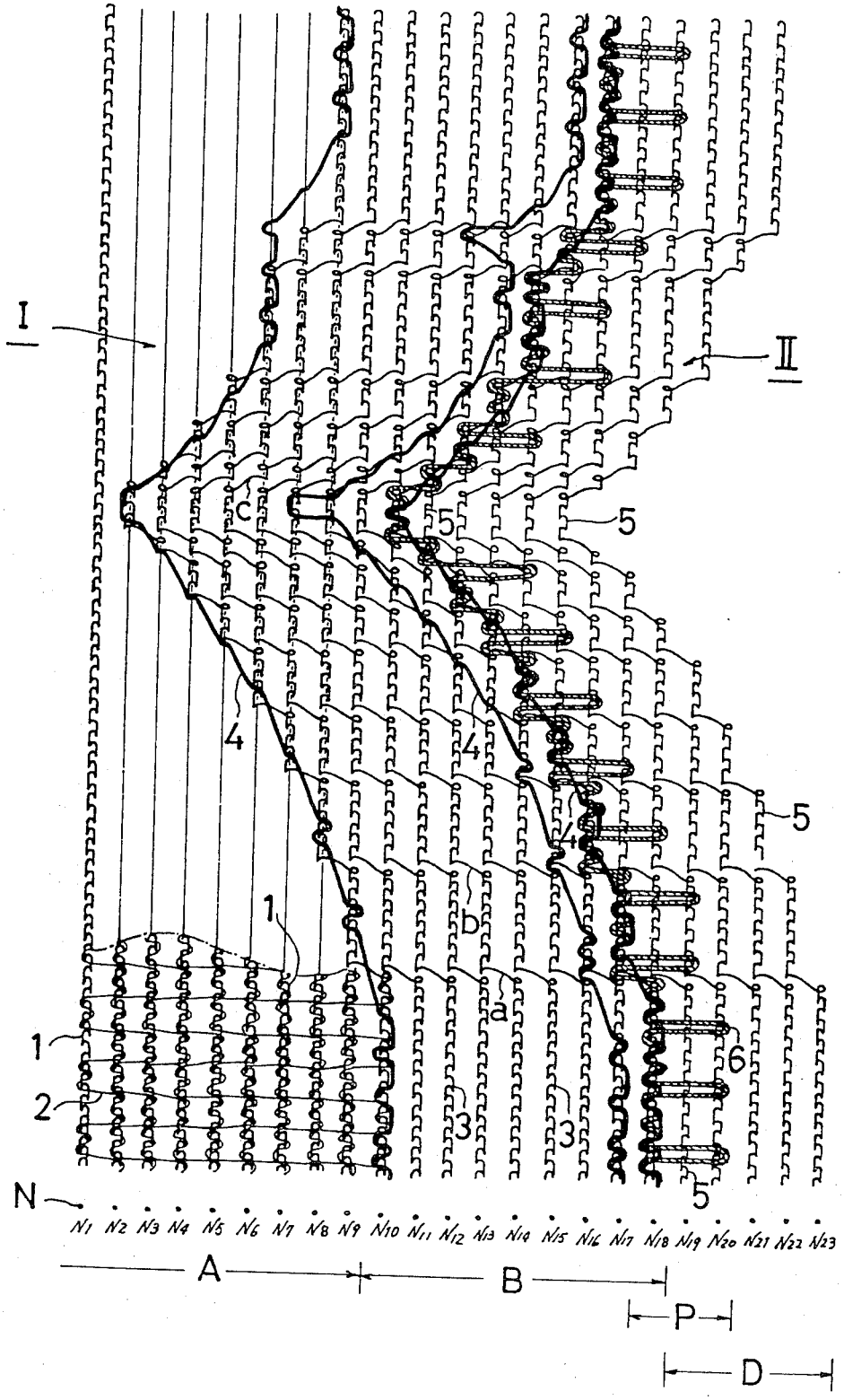
FIG. 4 is a view of an example of modified knit structure with respect to soluble warps shown in FIG. 2.

FIG. 4 is a view showing an example of modified knitting mode of soluble yarns 5, wherein the same reference marks as those corresponding to respective items in the other drawings are used. A point different from that in FIG. 2 is that the soluble warps 5 are knitted along sinuate line of the scallops B. When thus knitted, the width of the part D in which the warps 5 are arranged, namely, soluble fabric portion II, can be made smaller than that required for knitting the warps 5 in straight line along the direction of wale as shown in FIG. 2. For example, in the case of this drawing, threading of five ends of warp yarns 5 on respective five needles, $N_{19}$–$N_{23}$, may satisfy the purpose.

In this way, significant decrease in consumption of soluble yarn is obtained, which leads to a great degree of economy.

What has been hitherto described refers to the case in which a unit of lace fabric is knitted. However, a plurality of separated units of insoluble lace fabric 10 can be manufactured at a time by dissolving the soluble fabric portions II when the whole of the fabric is immersed into the water, the fabric being knitted into a piece constituted of insoluble fabric portions I and soluble ones II in which two different portions are arranged alternately with each other. In this case, separation of said piece into units without use of cutter and, in addition, formation of clear sinuate scallops and picots on the edge of each separate lace fabric are all possible.

Figure 5:
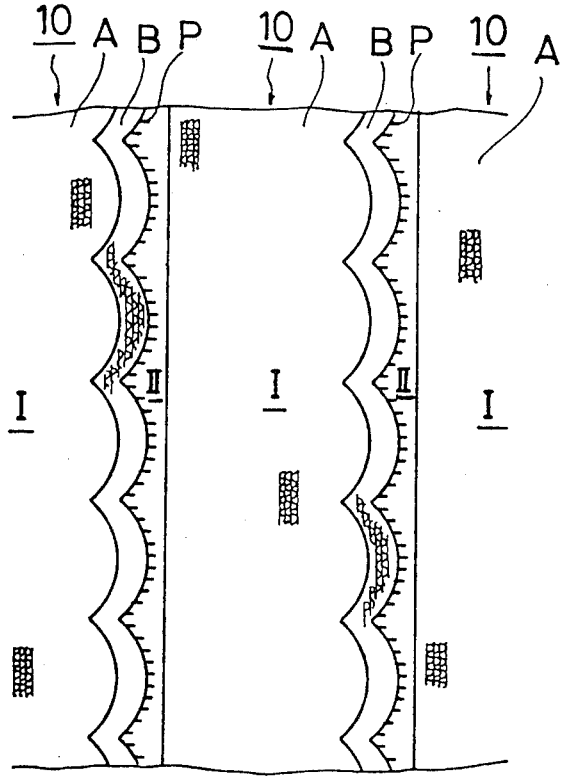
FIG. 5 is a schematic view of the fabric constituted of insoluble fabric portions and soluble ones in an alternation arrangement.
Figure 6:
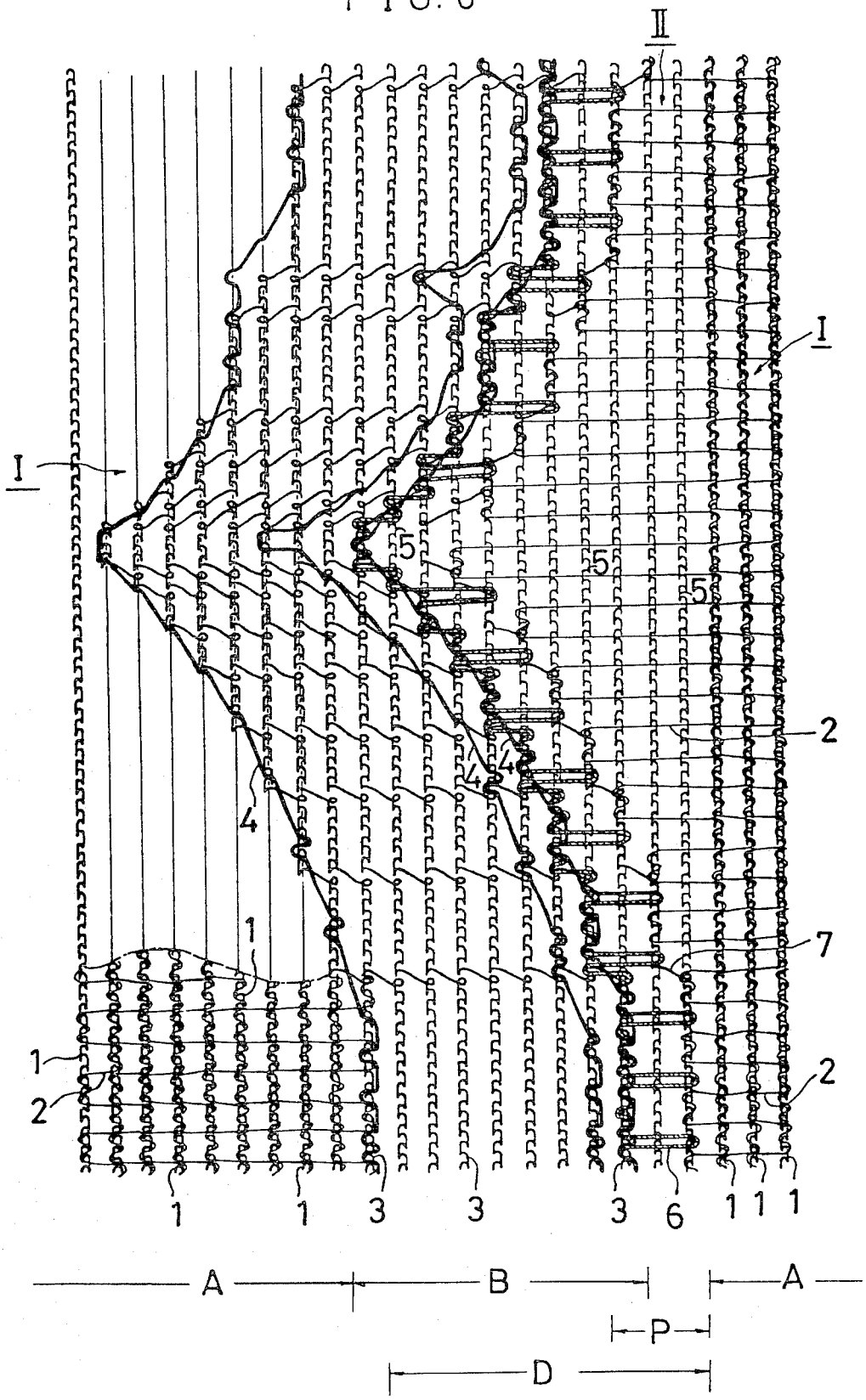
FIG. 6 is a view of knit structure showing the state wherein a basting yarn connects adjacent two isoluble two fabric portions with each other which are shown in FIG. 5.
Figure 7:
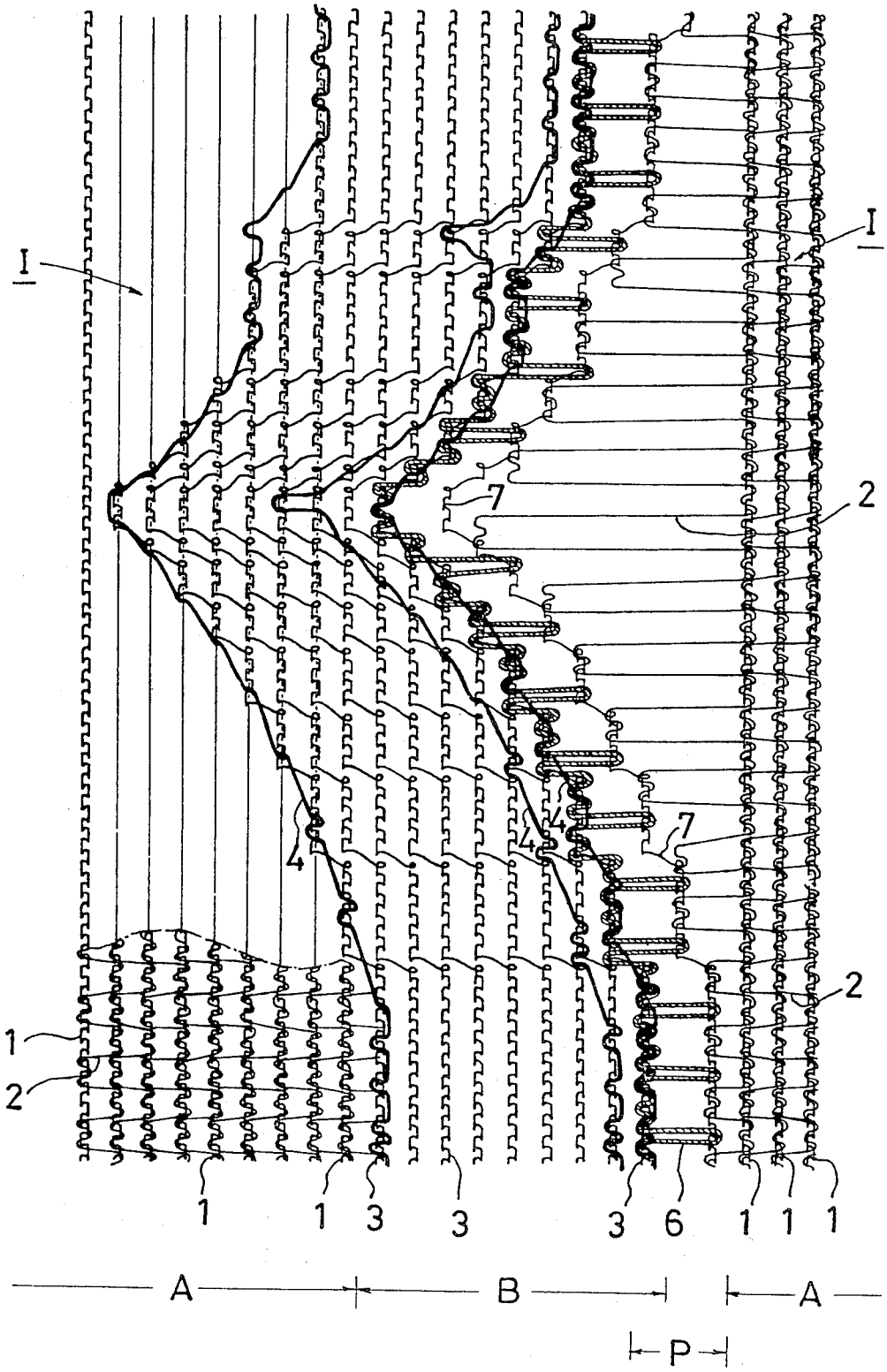
FIG. 7 is a view of knit structure remaining after the soluble fabric portion shown in FIG. 6 has been removed by dissolution.
Figure 8:
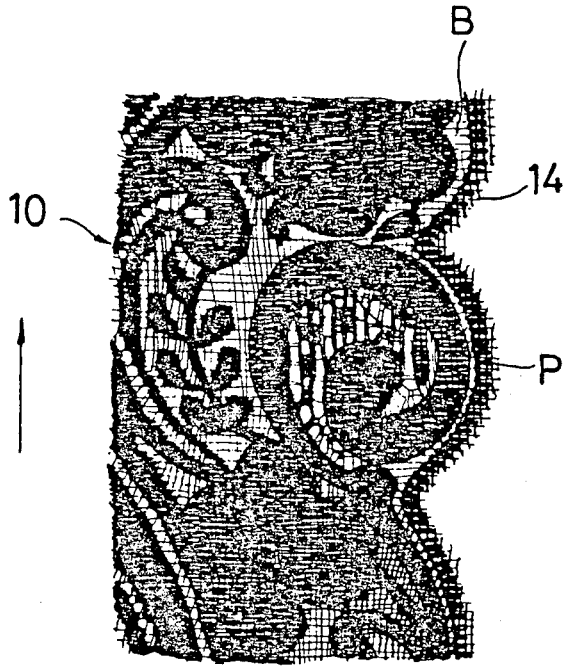
FIG. 8 is a sketch showing a part of a unit of lace strip according to conventional method. This strip has been cut off from the original material fabric along scallops by means of cutter.
Figure 9:
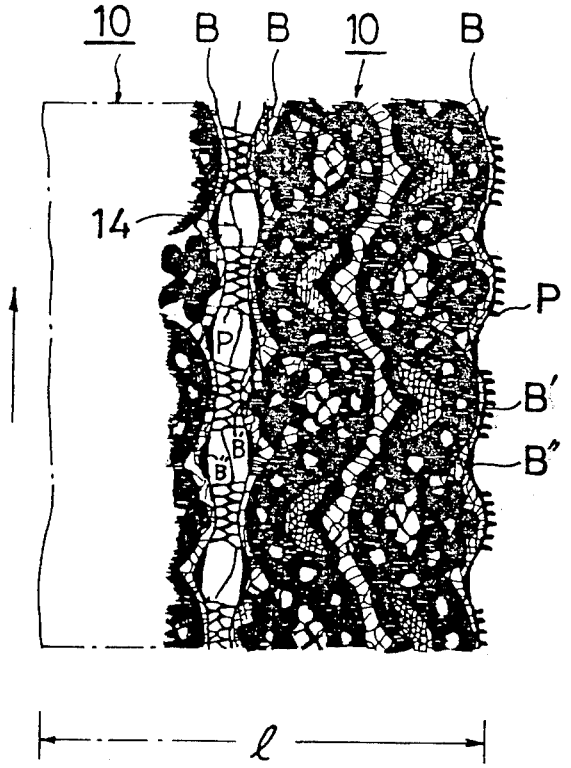
Figure 8A:
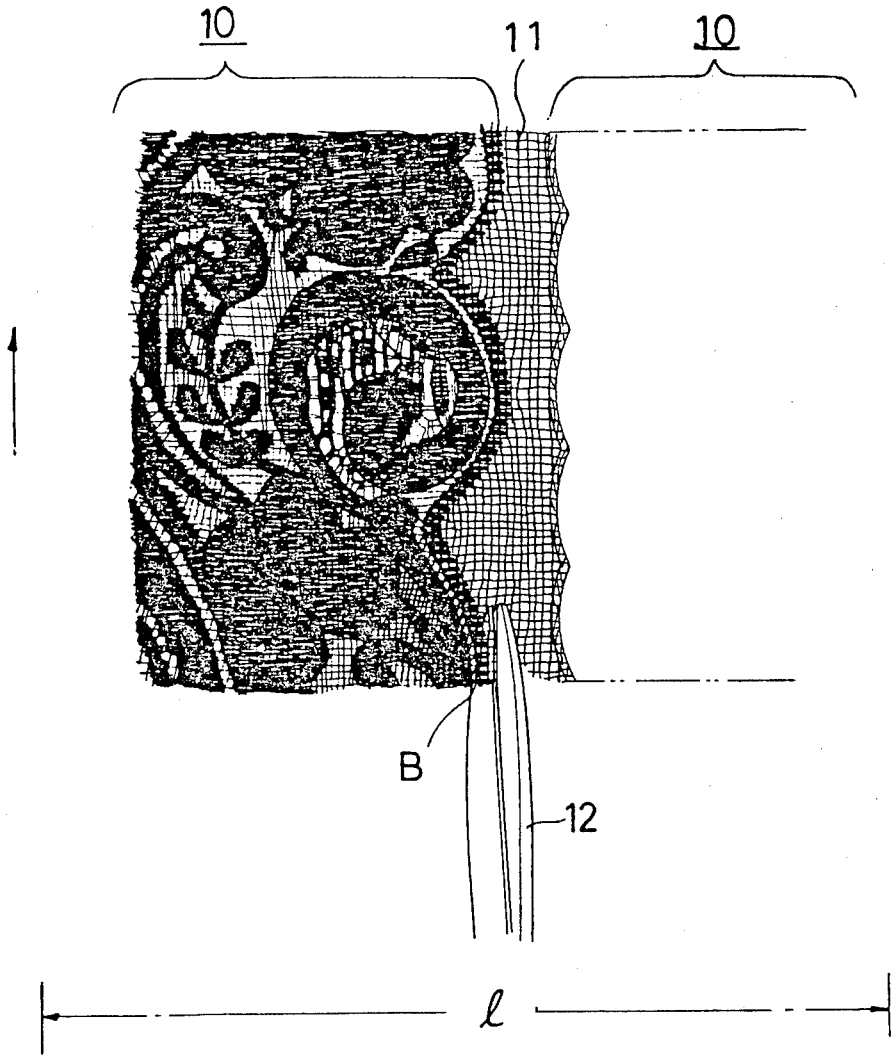
FIG. 8A is a sketch schematically showing the state in which a piece of fabric consisting of a plurality of knitted units is being cut by the cutter for obtaining lace strips as shown in FIG. 8; and, FIG. 9 is a sketch showing a part of the knitted piece separable into units of lace strip by removal of basting yarn.

FIG. 6 shows an example of modification of knit structure and knitting method shown in FIG. 5. Insoluble fabric portions I and soluble ones II are knitted in an arrangement of alternation with each other so as to form a piece containing a plurality of these portions, and adjacent insoluble portions I, I are connected with each other by insoluble basting yarn 7. This basting yarn 7 is knitted-in along sinuate line of the edge portion and connects the tip of the U-shaped protrusion formed of picot-forming yarn 6 with adjacent insoluble fabric portion I. Though not shown, adjacent insoluble fabric portions I, I may be connected with each other by two basting yarns, one of which is 7 as described above and the other is knitted-in between the abovesaid one 7 and adjacent insoluble fabric portion I. From the fabric knitted in this way, insoluble fabric portions II are removed by dissolution during immersion of the whole of the fabric. A fabric from which soluble yarns have been removed by dissolution is shown in FIG. 7. A plurality of lace strips 10 are manufactured by separating the fabric, which has soluble yarn thereof dissolved, taken out from the water, and dried up, into units of insoluble fabric portions I upon releasing the basting yarn 7 from the fabric. In this way, insoluble fabric portions are made inseparable from each other even after the dissolution of soluble fabric portions II, which makes easy drying operation after dissolution and ensure the manufacture of a multitude of lace strips at higher rate of efficiency.

What is claimed is:

1. The method of manufacturing an entirely warp-knitted lace strip into a knit portion which comprises:

forming U-shaped picots from insoluble yarns which protrude from the edges of said scallops by knitting same into the edges of the scallops, providing soluble fabric portions adjacent to said insoluble scallop yarns and said insoluble picot yarns, and dissolving said soluble fabric portions to separate the scallops and picot portions.

* * * * *